US005516091A

United States Patent [19]

Nakayama

[11] Patent Number: 5,516,091

[45] Date of Patent: May 14, 1996

[54] SHEET RECEIVING AND STACKING APPARATUS

[75] Inventor: Koji Nakayama, Ushiku, Japan

[73] Assignee: Riso Kagaku Corporation, Tokyo, Japan

[21] Appl. No.: 332,762

[22] Filed: Nov. 1, 1994

[30] Foreign Application Priority Data

Nov. 12, 1993 [JP] Japan ..... 5-283627

[51] Int. Cl.[6] ..... B65H 29/68

[52] U.S. Cl. ..... 271/182; 271/207

[58] Field of Search ..... 271/182, 207, 271/213, 220, 221, 222, 224

[56] References Cited

U.S. PATENT DOCUMENTS

| | | | |
|---|---|---|---|
| 411,750 | 9/1889 | Reiffel | 271/224 |
| 560,215 | 5/1896 | Hall | 271/222 |
| 2,992,823 | 7/1961 | Forrester | 271/222 |
| 4,319,744 | 3/1982 | Nagel et al. | 271/222 |
| 4,385,758 | 5/1983 | Ellsworth | 271/224 |

FOREIGN PATENT DOCUMENTS

| | | | |
|---|---|---|---|
| 0125562 | 7/1983 | Japan | 271/207 |
| 0226662 | 9/1989 | Japan | 271/220 |
| 0215648 | 8/1990 | Japan | 271/220 |
| 4-223963 | 8/1992 | Japan | 271/207 |

OTHER PUBLICATIONS

Ernst, IBM Technical Disclosure Bulletin, Copier Skew Reduction, Nov. 1980, p. 2217 of vol. 23 No. 6.

*Primary Examiner*—H. Grant Skaggs
*Attorney, Agent, or Firm*—Kanesaka & Takeuchi

[57] ABSTRACT

A sheet receiving and stacking apparatus is formed of a base table with a stacking section for stacking a rectangular sheet, and a guide device for receiving the rectangular sheet and for guiding the rectangular sheet to the stacking section of the base table. The guide device has a rotatable curved guide surface, and guides the rectangular sheet to the stacking section while being rotated with the side edges of the rectangular sheet when the guide surface has received the side edges of the rectangular sheet which is floating downwardly.

12 Claims, 6 Drawing Sheets

FIG. 1 *Prior Art*
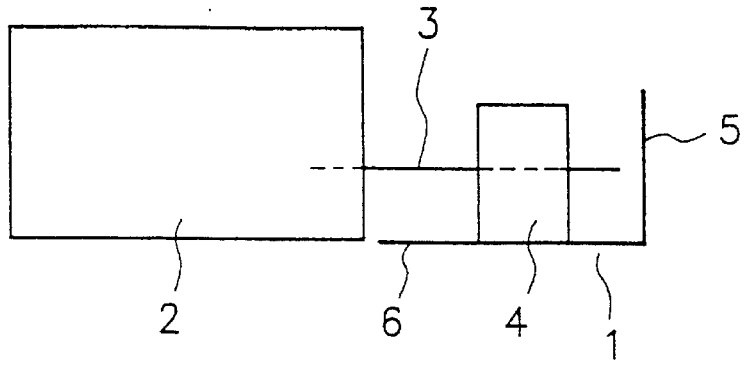
FIG. 2 *Prior Art*
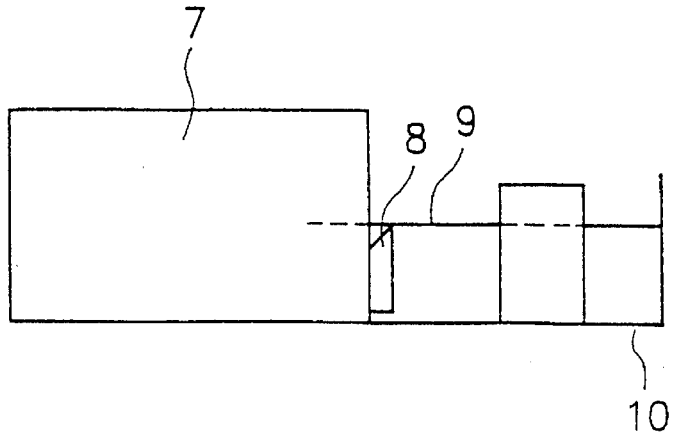

SHEET RECEIVING AND STACKING APPARATUS

BACKGROUND OF THE INVENTION

The present invention relates to a sheet receiving and stacking apparatus for receiving and stacking plastic sheets and other kinds of paper which are rectangular sheets and, more particularly, to a delivery apparatus in an image forming apparatus such as a printing apparatus.

Generally, as a sheet receiving and stacking apparatus for receiving and stacking rectangular sheets, a delivery apparatus provided at the discharge section of a printing apparatus has been known. This type of delivery apparatus 1, as shown in FIG. 1, commonly has a base table 6 for receiving printed paper 3, a pair of parallel side boards 4, 4 provided nearly vertically on both sides of the base table 6 in a direction of receiving of the paper 3, and an end plate 5 provided at the forward end of the base table 6 in the direction of reception of the paper 3. Both side edges of the printed paper 3 discharged out of the printing section of the printing apparatus 2 are received between the two side boards 4, 4 which are disposed parallel, generally equal to the width of the printed paper 3. The leading edge of the ejected paper 3 strikes the end plate 5 located at front and floats down to be stacked on the base table 6.

In such a delivery apparatus 1, when printing is performed at a low image-printing rate on the paper 3, that is, in the case of a small amount of printing ink to be transferred to the paper 3, the paper 3 is discharged out of the printing apparatus 2 without changing its flat form therefore there will occur no problem about the stacking of the paper 3 in the delivery apparatus 1. However, in the case of a high image-printing rate, for example when much of ink has been transferred to the paper 3 as in solid printing, the upper surface of the paper 3 to which the ink has been transferred extends largely, curling largely downwardly into an upwardly swollen form. The paper 3 discharged out of the printing apparatus 2, therefore, will be stacked in a disorderly fashion on the base table 6.

To solve this problem, there has been a printing apparatus 7 of known art which, as shown in FIG. 2, is provided with an auxiliary paper discharge member 8 at the entrance of the delivery apparatus 10 mounted in the paper delivery section. This auxiliary member 8 holds upwardly both side edges of the paper 9 in a direction of travel of the paper 9 that has been discharged out of the printing apparatus 7, bending the paper 9 into a form of a U letter in the delivery state to thereby provide the paper 9 with stiffness and to thereby prevent the paper 9 from being largely curled with the effect of ink and stacked on the delivery apparatus 10 in a disorderly fashion.

Another apparatus which curves paper into a U-letter form has been disclosed in Japanese Utility Model Laid-Open No. Hei 5-10367. This apparatus has a pair of side plates disposed to face each other at a spacing on the delivery table, a pair of guide members provided on the pair of side plates so disposed as to face each other and protrusible on the delivery table, and guide members driving means for driving the guide members by turning the guide members simultaneously with the delivery operation of the image forming apparatus.

The prior art delivery apparatus described above, however, has such a problem that both side edges of the paper 9 are partly held upwardly when the aforesaid auxiliary paper discharge member 8 is employed, but other portion of the paper 9 apart from the auxiliary paper discharge member 8 becomes free; the paper 9, therefore, is still affected by the ink to curl largely with the ink, resulting in unevenly stacked paper.

In the delivery apparatus in which the guide members provided on the side plates are forced to move in and out by the guide member driving member in synchronization with the delivery of paper from the image forming apparatus, it is difficult to control the guide member driving means in accordance with the hardness of the paper, or a difference in the stiffness of the paper, which is determined by a difference in thickness and weight which depend upon the kind of the paper. Besides, the construction of the delivery apparatus required for mounting the guide member driving means will become complicated, which will cause a trouble to occur and raise a manufacturing cost.

SUMMARY OF THE INVENTION

It is an object of the present invention to provide a sheet receiving and stacking apparatus of simple constitution for evenly stacking even such printed paper that has been subjected to curling with the effect of ink.

To solve the above-described problems, the invention according to a first aspect provides a sheet receiving and stacking apparatus comprising, a base table with a stacking section for stacking a rectangular sheet, and guide means for receiving said rectangular sheet and for guiding said rectangular sheet to the stacking section of said base table; said guide means having a rotatable curved guide surface, and guiding said sheet to said stacking section while rotating with the side edges of said sheet when said guide surface receives the side edges of said sheet which floats downwardly.

A sheet stacking and receiving apparatus of a second aspect is characterized in that, in the sheet stacking and receiving apparatus of the first aspect, said guide surface rotates along a direction of guiding said sheet towards said stacking section.

A sheet stacking and receiving apparatus of a third aspect is characterized in that, in the sheet stacking and receiving apparatus of the second aspect, said guide means is provided with a curved guide member and a support member for rockably and rotatably supporting said guide member so that said guide member move relative to said stacking section.

A sheet stacking and receiving apparatus of a fourth aspect is characterized in that, in the sheet stacking and receiving apparatus of the third aspect said guide member is spherical, and said support member comprises a shaft mounted through the center of said guide member, an arm secured on both ends of said shaft, and a support shaft for rockably supporting said arm.

A sheet stacking and receiving apparatus of a fifth aspect is characterized in that, in the sheet stacking and receiving apparatus of the third aspect said guide members are cylindrical, and said support member comprises a shaft mounted through the center of said guide member, an arm secured on both ends of said shaft, and a support shaft for rockably supporting the arm.

A sheet stacking and receiving apparatus of a sixth aspect comprises a base table with a stacking section for stacking a rectangular sheet, and guide members for receiving said rectangular sheet and for guiding said rectangular sheet to said stacking section of said base table said guide members comprising a guide member having a guide surface, and a connecting member having elasticity for rockably supporting said guide member so that said guide member moves outwardly with respect to said stacking section when said guide member receives the side edges of said rectangular sheet floating downwardly.

Rectangular sheets printed at the image forming apparatus are discharged onto the stacking section of the base table. The rectangular sheets are then received by the guide members, where their both side edges are held in contact with the movable members of the guide members, thus bending with its own weight to a downwardly curved U-letter form.

In the apparatus of the first aspect, the guide surface of the guide member rotates with the weight of the rectangular sheet, thus guiding the rectangular sheet to the stacking section.

In the apparatus of the second aspect, the guide surface of the guide member rotates with the weight of the rectangular sheet in the direction in which the rectangular sheet will be guided to the stacking section, thus guiding the rectangular sheet to the stacking section.

In the apparatus of the third to fifth aspect, the guide member supported by the support member rotates the guide surface with the weight of the rectangular sheet and also moves relative to the stacking section, and the rectangular sheet comes off the guide member and drops to the stack section, being stacked therein. The guide member released from the weight of the rectangular sheet returns to the original position with its own weight.

In the apparatus of the sixth aspect, the elastic member is elastically deformed with the weight of the rectangular sheet, moving the guide member outward of the stacking section. The rectangular sheet goes off the guide member, floating down to be stacked in the stacking section. The guide member released from the weight of the rectangular sheet returns with the elastic force of the elastic member to the original position protruding on the stacking section side.

BRIEF DESCRIPTION OF THE DRAWINGS

FIG. 1 is a side view showing the constitution of a conventional printing apparatus and delivery apparatus;

FIG. 2 is a side view showing the constitution of a conventional printing apparatus and delivery apparatus;

DESCRIPTION OF THE PREFERRED EMBODIMENTS

Hereinafter preferred embodiments of a sheet receiving and stacking apparatus according to the present invention will be described with reference to the accompanying drawings.

Figure 3:
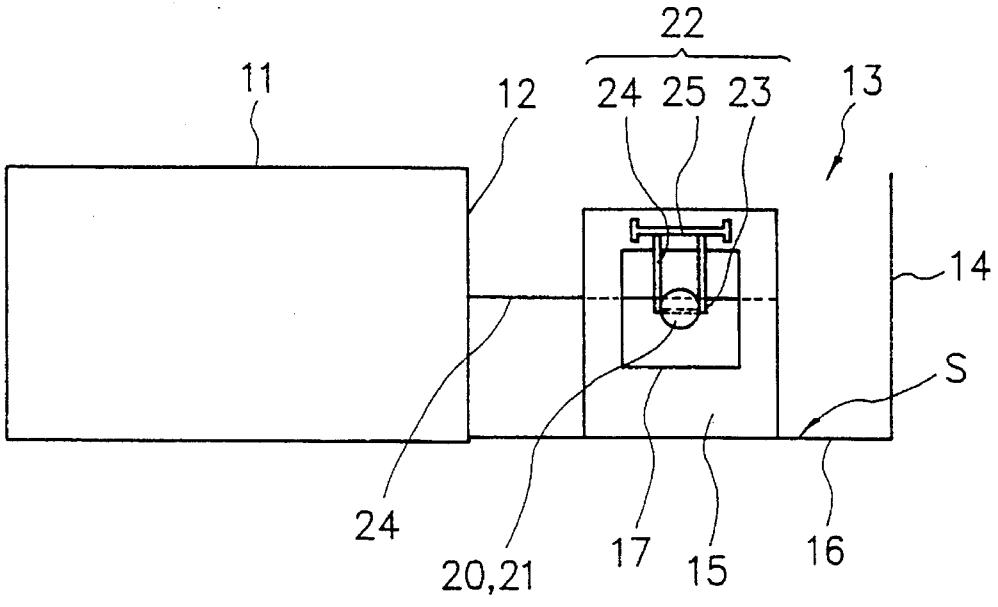
FIG. 3 is a side view of a first embodiment of the present invention.
Figure 4:
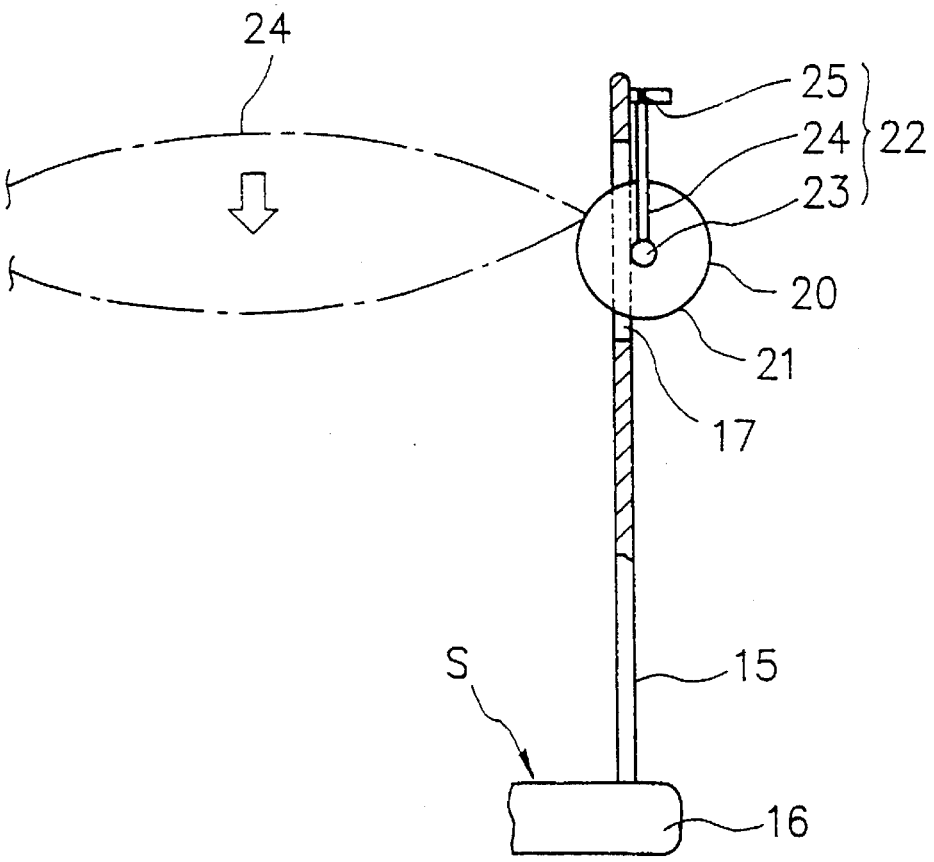
FIG. 4 is an enlarged partly sectional view of an enlarged major portion of the first embodiment of the present invention.

FIG. 3 is a side view showing a first embodiment of the printed sheet stacking apparatus according to the present invention; and FIG. 4 is a right side view of FIG. 3, partly sectioned, showing enlarged one of a pair of guide means of the sheet stacking and receiving apparatus of the present embodiment.

As shown in FIG. 3, a delivery apparatus 13 which is an apparatus for receiving and stacking paper is connected to the paper discharge side 12 of a mimeograph machine 11 which is an image forming means. The delivery apparatus 13 has an end plate 14 disposed nearly perpendicularly on the base table 16 and movably towards the mimeograph machine 11, for stopping the leading edge of printed paper as sheet. Also provided nearly at a right angle with the end plate 14 are a pair of side plates 15, which are movable towards the inside of the base table 16 in accordance with the size of the paper. The side plates 15 constitute a part of guide means for guiding the printed paper to the stacking section on the base table 16. The sheet stacking section S is defined on the base table 16 by these side plates 15, 15 and the end plate 14.

As shown in FIG. 3, the side plate 15 is provided with a window 17. As shown in FIG. 4, a guide member 20 as a guide means is mounted through the support member 22 outside of the window 17. A part of the guide member 20 protrudes inside of the side plate 15 from the window 17. The guide member 20 of the present embodiment is globular so that the guide surface 21 supporting the side edges of the sheet is spherical.

As shown in FIGS. 3 and 4, the support member 22 supporting the guide member 20 has a shaft 23 which is mounted through the center of the globular form, the guide member 20 being rotatable on the shaft 23. 0n either end of the shaft 23 one end of the arms 24 is secured at a right angle, while the other end of these arms 24 is rotatable connected on the outside surface of the side plate 15 through a support shaft 25 which is in parallel with the shaft 23. Therefore, the guide member 20 is rockable relative to the support shaft 25, partly protruding into the inside of the side plate 15 through the window 17, and is movable outwardly of the side plate 15 when an outward force is exerted.

According to the above-described constitution, a paper 24 discharged out of the mimeograph machine 11 is supported at both side edges on the guide surface 21 of the guide member 20, bending downwardly to a U-letter form to thereby prevent curling of the paper with ink as shown in FIG. 4.

Since the guide surface 21 is turned on the center of the shaft 23 with the weight of the paper 24 and the support shaft 25 as the whole rocks to move outside the side plate 15, the paper 24 comes off the guide member 20, floating downwardly to the stacking section S. With repetition of this operation, the paper 24 is stacked evenly on the stacking section S of the base table 16.

Figure 5:
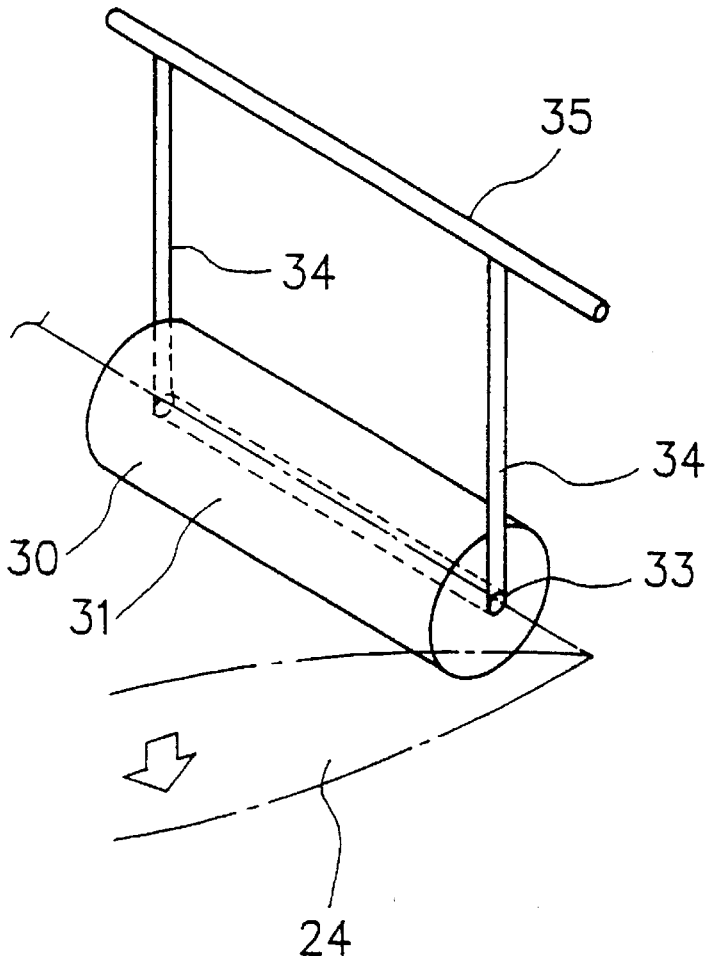
FIG. 5 is a perspective view of a major portion in the second embodiment of the present invention.

FIG. 5 is a perspective view showing a major portion of the second embodiment. In this drawing, the side plate is not illustrated. In the first embodiment is used the globular guide member 20. In the present embodiment, however, a cylindrical guide member 30 is rotatably supported by a shaft 33 which agrees with the center shaft of the cylindrical guide member 30. The shaft 33 is mounted in parallel with the direction of feed of the printed paper 24, and, similarly to the globular guide member 20, is rockably connected to, and suspended from, the outside surface side of the side plate 15 by a pair of arms 34 and a support shaft 35. A part of this cylindrical guide member 30, when not contacting the printed paper 24, is protruding from the window 17 of the side plate 15 to the inside surface side.

According to the above-described constitution, the printed paper 24 discharged out of the mimeograph machine is supported at both side edges by the cylindrical guide surface 31 of the guide member 30, bending downwardly to a U-letter form to thereby prevent the paper from curling. The printed paper 24 thus bent into the U-letter form is provided with stiffness, thereby being prevented from curling with ink which is likely to occur with the solid-printed paper. The guide surface 31 of the guide member 30 rotates with respect to the shaft 33 with the weight of the printed paper 24, and the whole body rocks with respect to the support shaft 35, moving to the outside of the side plate 15; and accordingly the printed paper 24 comes off the guide member 30, floating down onto the stacking section S. With repetition of this operation, the paper 24 is stacked evenly on the stacking section S of the base table 16.

The same effect of operation can be obtained by using a disc-like guide member in place of the cylindrical guide member 30. In this case, the disk is suspended from the side plate 15 or another member, rotatably at the center thereof, so that the whole body of the disc will be rotatable. The rotatable and rockable constitution can be realized by nearly the same supporting mechanism as the guide member 30.

In the case of the disc-like guide member, the outer peripheral surface serves as the guide surface; however, when it is not wide enough to support the printed paper or when otherwise necessary, a plurality of disc-like guide members of the same outside diameter may be rotatably provided on a common rotating shaft.

Figure 6:
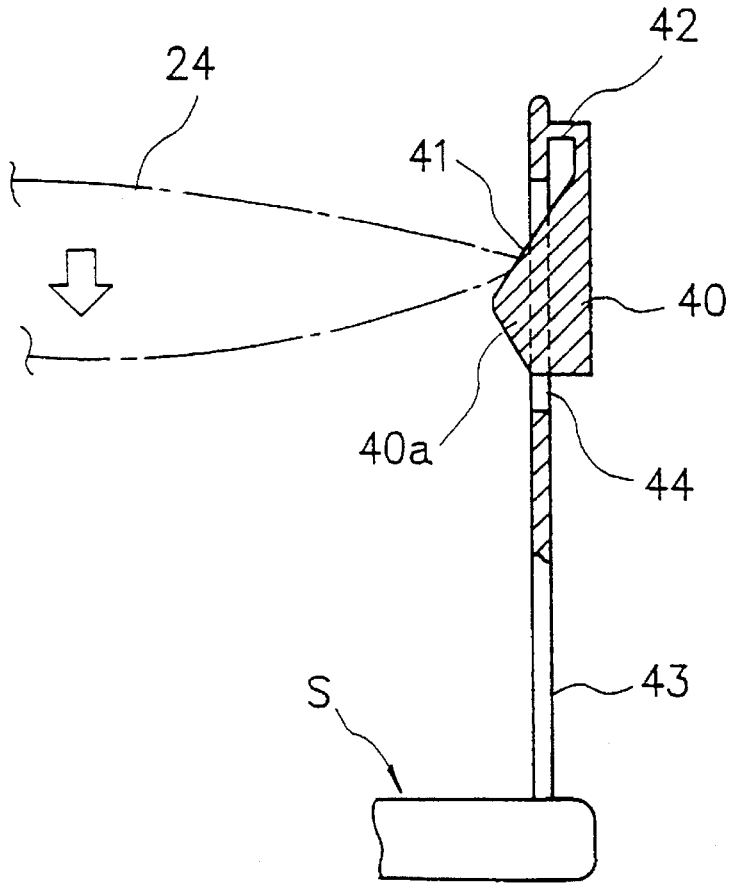
FIG. 6 is a partly sectional view of an enlarged major portion of the third embodiment of the present invention.

FIG. 6 is a side view showing the third embodiment of the present invention. FIG. 6 shows the sheet stacking and receiving apparatus of the present embodiment viewed from the same direction as FIG. 4, showing one of a pair of guide means of the apparatus.

A guide member 40, a side plate 43, and a connecting member 42 which connects the guide member 40 with the side plate 43 are molded of plastic resin as one unit. The guide member 40 has a nearly square sectional form at a cut surface intersecting at a right angle with the direction of discharge of the printed paper 24; a part of the stacking section S side forms an angle guide section 40*a* protruding triangular in a sectional form. The upper surface of this guide section 40*a* serves as a guide surface 41 for guiding the printed paper 24; the guide surface 41 being in parallel with the direction of discharge of the printed paper 24 and being inclined towards the inside of the stacking section S relative to the horizontal surface.

In the side plate 43 is formed a window 44 similarly to each of the embodiments heretofore described. The guide section 40*a* of the guide member 40 is located above the side of the stacking section S for stacking the printed paper 24, protruding into the side plate 43 through this window 44.

The upper end of the guide member 40 is connected to the outside surface of the side plate 43 via the connecting member 42. In particular, the connecting member 42 extends upwardly from the upper end of the guide member 40 located on the outside of the side plate 43, and further extends horizontally towards the side plate 43, at which it is connected to the outside surface of the side plate 43. The connecting member 42 has elasticity required, so that when the guide member 40 has received the side edges of the printed paper 24, the guide member 40 is permitted to move from the window 44 to the outside of the side plate 43. After the printed paper has come off the guide member 40, the guide member 40 is allowed to return to the original position.

According to the above-described constitution, both edges of the printed sheet 24 discharged out of the mimeograph machine are supported on the inclined guide surface 41 of the guide member 40, and the central portion of the paper 24 bends downwardly into a U-letter form. The printed paper 24 thus bent into the U-letter form has stiffness, and therefore it is possible to prevent curling with ink likely to occur in the case of solid printing. The connecting section 42 is elastically deformed with the weight of the printed paper 24, causing the whole body of the guide member 40 to rock towards the outside of the side plate 43. The printed paper 24 comes off the guide member 40, floating downwardly onto the stacking section S. With the repetition of this operation, the printed paper 24 is stacked orderly on the stacking section S of the base table.

Figure 7:
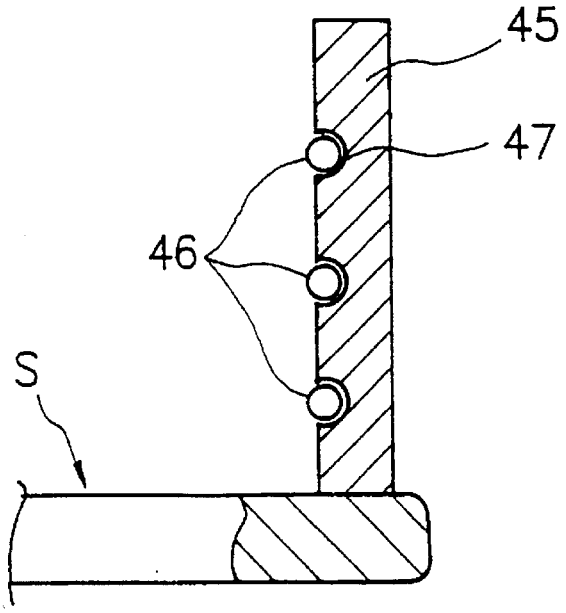
FIG. 7 is a partly sectional view of an enlarged major portion of the fourth embodiment of the present invention.

FIG. 7 is a side view of the fourth embodiment of the present invention. FIG. 7 is a view showing one of a pair of guide means for the sheet stacking and receiving apparatus, with the sheet stacking and receiving apparatus of the present embodiment viewed from the same direction as FIG. 4.

The side plate 45 of the present embodiment has guide members 46 inside, which comprise a plurality of relatively small balls protruding to the stacking table S. These guide members 46 are rotatably fitted in spherical cavities 47 formed in the inside surface of the side plate 45. For the fitting construction or means such as the balls and cavities 47 forming the guide members 46, a known art capable of rotating the balls smoothly in any direction may be adopted. For example, a number of ball-like fine particles may be uniformly disposed between the ball and the cavity 47, with the head part of each of the balls rotatably exposed so that the ball will not come out off the side plate 45. Furthermore a slip agent such as silicon may be used between the ball and the cavity 47 for smooth rotation of the ball; in this case, however, the amount of the slip agent to be used must not be so much as to smear the side edges of the printed paper 24.

In the embodiment shown in FIG. 7, the guide member 46, which is formed of a number of small balls inserted inside of the side plate 45, protrudes very little out on the stacking table S side. Therefore, there is no necessity to provide a structure, such as the guide member described in each embodiment, for moving the guide member 46 to the outside of the side plate 45; the guide member 46 of the present embodiment may be located in a fixed position of the side plate 45.

In the above embodiments, the guide member is not necessarily required to be mounted directly on a stationary member such as the side plate; that is, the guide member must not be connected mechanically to the side plate so long as it is freely protrusible to the stacking section side for stacking the printed paper through the window or other of the side plate or other.

For the material of the guide member a known metal and non-metal is usable; it is desirable that the guide surface which comes in contact with the side edges of the printed paper be a smooth surface in order to insure smooth guide of the printed paper to the stacking table. Also, a large number of the guide member is not required on each side plate. For the number and arrangement of the guide members, a plurality of rows and lines can be selected. However, when the guide member has a pair of side plates which are arranged parallel and nearly vertically on both sides of the base table, it is desired that the same number of guide members be mounted in the same position on each side plate. Furthermore, the side plate may be movable towards the center of the base table similarly to the prior art. Furthermore, the base table or the printed paper stacking section is desired to be curved in a U-letter form.

Each embodiment explained above is concerned with the paper discharge apparatus of the printing machine; the purpose of the present invention, however, is not limited to the paper discharge apparatus of the printing machine and may be easily selected by those skilled in the art if its object is to maintain an even stack of plastic films and other kinds of sheets.

According to the present invention, as explained above, it is possible to provide the printed paper, even the printed paper solid-printed to curl owing to sufficient absorption of ink, with U-letter rigidity by the guide member which receives on the guide surface and freely moves. Therefore, the printed paper discharged out of the printing machine can be stacked evenly on the base table.

What is claimed is:

1. A sheet receiving and stacking apparatus for a rectangular sheet with two side edges parallel to each other, comprising:

a base table having two side portions and a stacking section situated between the two side portions, said stacking section receiving the rectangular sheet thereon, and a plurality of guide means attached to the respective side portions of the base table to be parallel to the side edges of said rectangular sheet to be fed, said guide means guiding said side edges of the rectangular sheet introduced above the stacking section to locate the rectangular sheet onto said stacking section of said base table, each of said guide means having a rotatable member, said rotatable members guiding said sheet to said stacking section while rotating with the side edges of said sheet when said rotatable members contact the side edges of said rectangular sheet which floats downwardly.

2. A sheet receiving and stacking apparatus as claimed in claim 1, wherein said members rotate along a direction of guiding said sheet towards said stacking section.

3. A sheet receiving and stacking apparatus as claimed in claim 2, wherein at least one of said guide means is provided with a support member for rockably and rotatably supporting its said rotatable member so that said rotatable member moves relative to its said stacking section.

4. A sheet receiving and stacking apparatus as claimed in 3, wherein said rotatable member of said at least one guide means is spherical, and said support member comprises a shaft mounted through the center of said rotatable member, arms secured on both ends of said shaft, and a support shaft for rockably supporting said arms.

5. A sheet receiving and stacking apparatus as claimed in claim 3, wherein said rotatable member of said at least one guide means is cylindrical, and said support member comprises a shaft mounted through the center of said rotatable member, of said at least one guide means arms secured on both ends of said shaft, and a support shaft for rockably supporting said arms.

6. A sheet receiving and stacking apparatus as claimed in claim 1, wherein one guide means is formed on each side portion, said rectangular sheet being transferred above the stacking section parallel to the two guide means.

7. A sheet receiving and stacking apparatus as claimed in claim 1, wherein each of said guide means includes a side plate fixed to the base table and having a window therein, and a support member having a support shaft attached to the side plate, arms attached to the support shaft and a shaft attached to the arms and rotatably supporting said rotatable member in the window so that when the rectangular sheet falls down between the side plates, the side edges of the sheet contact the rotatable members to thereby rotate the rotatable members and to push the same outwardly through the support member.

8. A sheet receiving and stacking apparatus as claimed in claim 1, wherein each of said guide means includes a side plate fixed to the base table and having a plurality of cavities therein, each of the cavities retaining one rotatable member therein to guide the side edges of the sheet.

9. A sheet receiving and stacking apparatus as claimed in claim 8, wherein said cavities are arranged vertically at a side facing the stacking section.

10. A sheet receiving and stacking apparatus for a rectangular sheet with two side edges parallel to each other, comprising:

a base table having two side portions and a stacking section situated between the two side portions, said stacking section receiving the rectangular sheet thereon, and two guide means attached to the respective side portions of the base table, each guide means having a side plate attached to the base table, a window situated in the side plate, an elastic connecting member fixed to the side plate, and a guide member connected to the connecting member and located in the window, a part of said guide member being situated above the stacking section so that when the rectangular sheet is introduced above the stacking section and falls downwardly, the side edges of the sheet contact the parts of the guide members and push the guide members outwardly through the elastic connecting members to thereby float downwardly on the stacking section.

11. A sheet receiving and stacking apparatus as claimed in claim 10, wherein said guide member includes an upper guide surface and an inner point, said upper guide surface extending downwardly from the connecting member to the inner point, said side edges of the sheet contacting the upper guide surfaces and pushing the same laterally outwardly to pass between the guide members.

12. A sheet receiving and stacking apparatus as claimed in claim 11, wherein said guide member includes a lower guide surface extending downwardly from the inner point.

* * * * *